United States Patent [19]

Meisner et al.

[11] Patent Number: 4,744,513

[45] Date of Patent: May 17, 1988

[54] DEVICE AND PROCESS FOR THE ELECTROSTATIC COATING OF ARTICLES WITH FLUIDS

[75] Inventors: Roland-Andreas Meisner, Senden; Gerd-Rüdiger Kissau, Münster, both of Fed. Rep. of Germany

[73] Assignee: BASF Farben & Faser AG, Hamburg, Fed. Rep. of Germany

[21] Appl. No.: 63,728

[22] Filed: Jun. 15, 1987

Related U.S. Application Data

[63] Continuation of Ser. No. 837,668, Mar. 4, 1986, abandoned, which is a continuation of Ser. No. 543,873, Oct. 20, 1983, abandoned.

[30] Foreign Application Priority Data

Oct. 21, 1982 [DE] Fed. Rep. of Germany ..... 3238917
Nov. 10, 1982 [DE] Fed. Rep. of Germany ..... 3241504

[51] Int. Cl.[4] ..... B05B 5/04

[52] U.S. Cl. ..... 239/3; 239/223; 239/703

[58] Field of Search ..... 239/104, 105, 3, 22.3, 239/22.4, 700–707, 690, 691, 698, 290, 296, DIG. 14; 118/621, 623; 427/47, 31

[56] References Cited

U.S. PATENT DOCUMENTS

| | | | |
|---|---|---|---|
| 1,832,096 | 11/1931 | Chaffee et al. | 239/707 X |
| 2,607,574 | 8/1952 | Hession | 239/224 X |
| 2,896,571 | 7/1959 | Geertsen | 239/296 X |
| 2,926,106 | 2/1960 | Gauthier | 239/707 X |
| 2,967,667 | 1/1961 | Norris | 239/701 |
| 3,004,714 | 10/1961 | Flury | 239/224 |
| 3,055,592 | 9/1962 | Probst | 239/224 X |
| 3,131,091 | 4/1964 | Jones | 118/623 X |
| 3,195,819 | 7/1965 | Tamotsu | 239/700 X |
| 3,580,509 | 5/1971 | Goss . | |
| 3,592,222 | 7/1971 | Goss et al. . | |
| 3,690,067 | 9/1972 | Goss et al. . | |
| 3,698,635 | 10/1972 | Sickles | 239/706 X |
| 3,764,068 | 10/1973 | Laachia | 239/707 X |
| 3,799,440 | 3/1974 | Goss et al. . | |
| 3,802,628 | 4/1974 | Goss et al. . | |
| 3,858,358 | 1/1975 | Stachowiak et al. . | |
| 3,939,800 | 3/1976 | Bunker | 118/621 X |
| 4,011,991 | 3/1977 | Masuda | 239/708 |
| 4,037,561 | 7/1977 | LaFave et al. | 239/703 X |
| 4,369,205 | 1/1983 | Winterling et al. | 118/623 X |
| 4,376,443 | 3/1983 | Mondy | 51/8 |
| 4,423,840 | 1/1984 | Coeling | 239/3 |

FOREIGN PATENT DOCUMENTS

| | | | |
|---|---|---|---|
| 470914 | 3/1967 | France | 239/698 |
| 2,336,182 | 7/1977 | France | 239/703 |
| 288904 | 4/1928 | United Kingdom | 239/224 |
| 725714 | 4/1980 | U.S.S.R. | 239/703 |

*Primary Examiner*—Andres Kashnikow
*Assistant Examiner*—Kevin Patrick Weldon
*Attorney, Agent, or Firm*—Kenyon & Kenyon

[57] ABSTRACT

A process and apparatus is disclosed comprising a high-speed rotation bell for applying quick-evaporating fluids, such as quick-evaporating liquid paint, wherein the impact deposition of largely evaporated paint particles on the high-speed rotation bell is prevented by affecting the flight path of the paint particles flying back in the zone of the toroidal vortex toward the high-speed rotation bell with electric or magnetic or aerodynamic forces or combinations of these forces.

24 Claims, 4 Drawing Sheets

Z
Y
X
Pel = Q · E
Pmagn = Q · [v × B]
Pae = k · w²D²

DEVICE AND PROCESS FOR THE ELECTROSTATIC COATING OF ARTICLES WITH FLUIDS

This application is a continuation of application Ser. No. 837,668, filed Mar. 4, 1986, now abandoned, which is a continuation of application Ser. No. 543,873, filed Oct. 20, 1983, now abandoned.

FIELD OF THE INVENTION

This invention relates to a device for the electrostatic coating of articles with fluids such as quick evaporating liquid paint and to a process for the electrostatic coating of articles with fluids such as quick evaporating liquid paint.

BACKGROUND OF THE INVENTION

Fluids, for example paints, are applied by means of high-speed bell atomizers which, by virtue of their shape, act on the inside like a turbo machine, i.e. they suck gas in from the surrounding atmosphere, deflect this gas and transport it back to the outside, so that a toroidal vortex forms inside and in front of the bell cavity.

In the application of fluids which evaporate quickly, for example, metallic base paints which are currently widely used, the gas contains very fine particles, for example paint particles, which deposit on the hub plate of the bell atomizer and contaminate this hub plate. Since the deposited particles no longer flow freely, if at all, solids-rich ridges grow on the hub plate until after a short period—which depends on their size—they are flung from the hub plate and pass into the paint film guided by the bell atomizer and from there onto the article to be coated or painted, where they cause considerable surface imperfections. This process of contaminating the hub plate and the tearing-off of these deposited ridges takes place very rapidly, so that a painting process cannot usually be completed without the appearance of the above-mentioned surface imperfections.

In the case of fluids, for example paints, which evaporate slowly, these particles are still sufficiently moist when arriving on the hub plate for them not to adhere, and the paint particles deposited on the hub plate are immediately radially accelerated on the hub plate and pass into the freshly metered paint stream without accumulating and hence being the cause of surface imperfections on the article being painted.

In the case of high-viscosity or low-viscosity paints or fluids, the devices described in German Pat. No. 3,005,677 and German Offenlegungsschrift No. 3,047,670 respectively provide an adequate solution. However, in the case of paints which evaporate quickly, for example, metallic base paints, these known devices provide no guidance for avoiding the difficulties described above.

It has also become known in practice to wet the hub plate, via a by-pass flow, with fresh paint. This way of solving the problem tends to lead to contamination in the narrow bore, since the bore has to have such a small diameter as to set the by-pass flow in rotation as it passes through. To ensure that the by-pass functions, these systems need to be fed with the material in the center, and that means it is not possible to mount separate feed ducts for incompatible fluids and for solvents, so that the possibilities of rapid color change are strictly limited in these existing devices. The existing type of device is also frequently prone to color entrainment effects. In addition, inadequate rinsing can lead to blockages in the bore and hence to wetting problems on the hub plate.

OBJECTS OF THE INVENTION

It is therefore an object of the present invention to provide a device, and a process, for applying quick-evaporating fluids by means of a high-speed rotation bell without permitting the action of the toroidal vortex to contaminate the hub plate of the high-speed rotation bell.

These and other objects of the present invention will become apparent from the following description and claims in conjunction with the drawings.

SUMMARY OF THE INVENTION

In accordance with the present invention, there is provided a bell cavity which points at the article to be coated. The bell cavity of the invention is complemented by a body which projects forward above the bell cavity and which has been connected to the bell, which rotates at a high speed, in such a way that it rotates therewith and electrical conduction occurs. The body is arranged with respect to the bell cavity so as to point at the article to be coated.

The present invention is further directed to a process which comprises generating an electric field in front of the atomizing bell cavity and above a body which is electrically connected to the spraying bell.

The present invention further comprises generating a magnetic field within the zone of the outer surface of a body arranged in front of the cavity of the atomizing bell.

In accordance with the present invention, the above-mentioned body is advantageously designed as an aerodynamic displacing body around which the particles flying back in the toroidal vortex have to flow.

The present invention avoids the impact deposition of largely already evaporated paint particles on the high-speed rotation bell by affecting the flight path of paint particles flying back in the toroidal vortex zone to the high-speed rotatation bell with electric or magnetic or aerodynamic forces or with a combination of these forces.

The process and apparatus of the present invention are based on the following considerations:

An electrically charged particle in an electric field is subject to a force in the direction of the electric field lines;

An electrically charged particle in a magnetic field is subject to a force at a right angle to the magnetic field lines; and A particle of mass flowing in a gas stream around an aerodynamic displacing body is deflected by drag forces in such a way that no deposition on the aerodynamic displacing body takes place.

The use of all three of these above-mentioned possibilities or a combination of one or more of them leads to high-speed rotation bells with which even quick evaporating fluids, for example metallic base paints, can be applied in a problem-free manner, namely without contaminating the hub plate and hence without these deposited contaminating particles tearing from the hub plate and causing imperfections on the surface of the article being coated.

The above-mentioned ways of affecting the flight path of the paint particles are realized as follows, all in accordance with the present invention:

As is known, the high-speed rotation atomizing bell is maintained under a high electrical potential. This high potential is necessary to charge up the paint and to transport the atomized paint particles to the article which they are to coat. In accordance with the present invention, an aerodynamic body is attached in front of the high-speed rotation bell and is firmly connected to this bell in an electrically conductive manner and is hence on the same voltage potential as the high-speed rotation bell.

The particles flying back in the toroidal vortex have a charge of the same polarity as the high-speed rotation bell, or they have an opposite polarity, or they are uncharged. All three possibilities can occur in the back flowing particle cloud.

The aerodynamic body arranged in front of the high-speed rotation bell in such a way as to rotate therewith is designed so as to have a local field strength which reaches or exceeds the dielectric strength of the surrounding gas at a point through which the paint particles which are preferentially deposited fly back, so that charges are emitted. As a result, a charge cloud forms at this point. The particles flying back are charged up further in this charge cloud or—if they originally were of opposite polarity—are recharged with opposite polarity. Approaching uncharged particles are charged up again.

Since the direction of the flight path of the approaching particles does not coincide with the direction of the field lines in the zone of aerodynamic body, the particles are pushed away by the aerodynamic body [effect of the electric repulsion force $P_{el}(P_{el}=Q\times\vec{E}$].

Magnetic forces have a similar effect. These deflect the charged particles in the direction of the rotation movement of the atomizing bell. The resulting centrifugal force imparts to the particles another force which displaces the flight path of the particles away from the aerodynamic body [$P_{magn}=Q\times(\vec{v}\times\vec{B})$].

The geometrical contour of the aerodynamic displacing body is given such a shape that the gas flows around this body in such a way that the paint particles approaching in flight do not have the possibility of penetrating the boundary flow layer ($P_{ae}=K\times w^2.D^2$).

In the above equations:

Q denotes the charge on the droplets,

D denotes the diameter of the particles, v denotes the flight velocity, w denotes the relative velocity between gas and droplets, and K denotes a geometrical constant.

The paths of the paint particles can, however, also be affected, according to the invention, by applying an auxiliary gas stream along the aerodynamic body against the direction of the approaching paint particles to deflect the toroidal vortex flow away from the contour.

An applied auxiliary gas stream can be obtained along the entire contour of the aerodynamic body in the form of an axially generated free gas jet. The particles are displaced from the aerodynamic body by the resulting drag forces.

The individual forces or the resultant force from combinations of these individual forces have the effect that the paint particles approaching in flight do not impact on the surface of the body and hence do not contaminate the body, and the surface imperfections in the painted article which had been a problem in the prior art are avoided by use of the process and apparatus of the present invention.

BRIEF DESCRIPTION OF THE DRAWINGS

In the drawings forming part hereof.

In the figures of the drawings, similar parts are indicated by like reference numerals.

DETAILED DESCRIPTION

In order to afford a more complete understanding of the present invention and an appreciation of its advantages, a detailed description of preferred embodiments is presented below with reference to the drawings.

Figure 5:
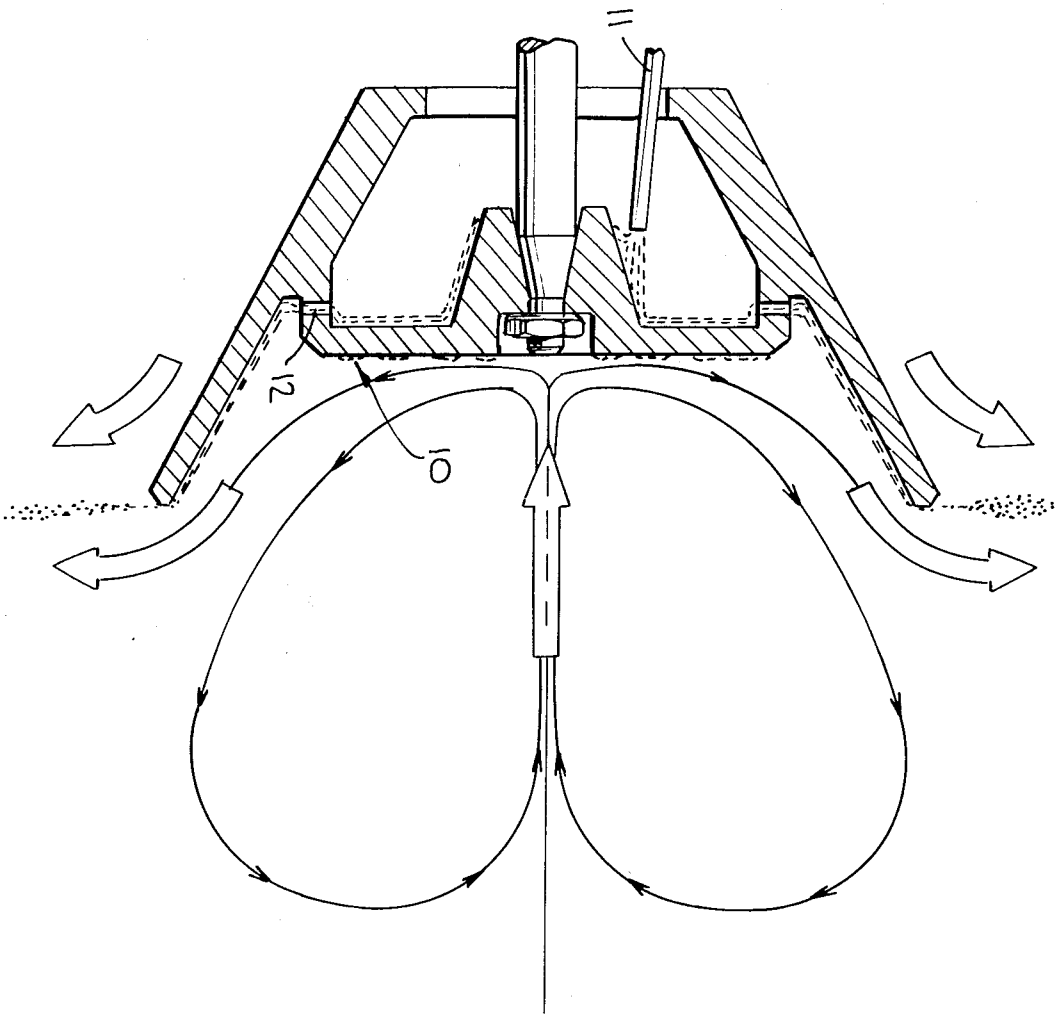
FIG. 5 is a schematic cross-sectional view illustrating a state of the art high-speed rotation bell with a toroidal vortex drawn in and ridge formation on the hub plate.

In the drawings, 1 identifies the bell body of a high-speed rotation bell, this bell body 1 being made of an electrically conductive material, for example, aluminum. 10 is the hub plate of this bell body 1. The paint is applied by means of a feedline 11 (FIG. 5) to the back of the hub plate 10. The paint film is guided through appropriate passages or openings 12 in the hub plate 10 to the inner surface of the rotation bell, as can be seen particularly clearly in FIG. 5.

Figure 6:
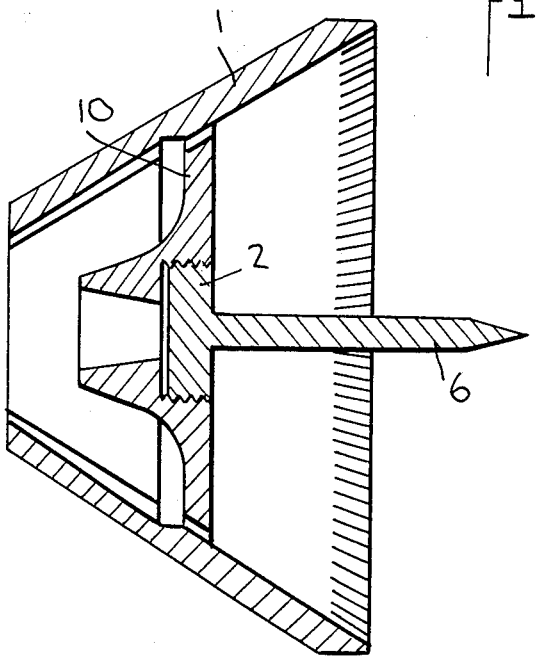
FIG. 6 is a schematic cross-sectional view illustrating still another embodiment of a high-speed rotation bell in accordance with the present invention.

An electrode needle 6 (FIG. 6) or an aerodynamically shaped displacing body 3 (FIGS. 1, 2, and 3) is fixed against the hub plate 10 by means of a holding device 2 and is thereby connected to the high-speed rotation bell in an electrically conductive manner. The holding device 2 for connecting the electrode needle 6 or the displacing body 3 to the hub plate 10 must be made of electrically conductive material.

The displacing body 3 can be designed to be hollow, and the resulting cavity can be filled with packing pieces 4 (FIG. 1) made of magnetic material. At the tip of the displacing body 3, there is arranged an electrode needle 6 made of electrically conductive material, or the displacing body can be, as shown in FIG. 2, shaped in such a way at its tip as to form the electrode needle 6. The tip of the displacing body 3, i.e., the end of the electrode needle 6 facing the body to be coated, suitably has a radius as close to zero as possible.

A magnet 8 (FIG. 1) has been installed as a permanent magnet on the inside of the displacing body.

Figure 3:
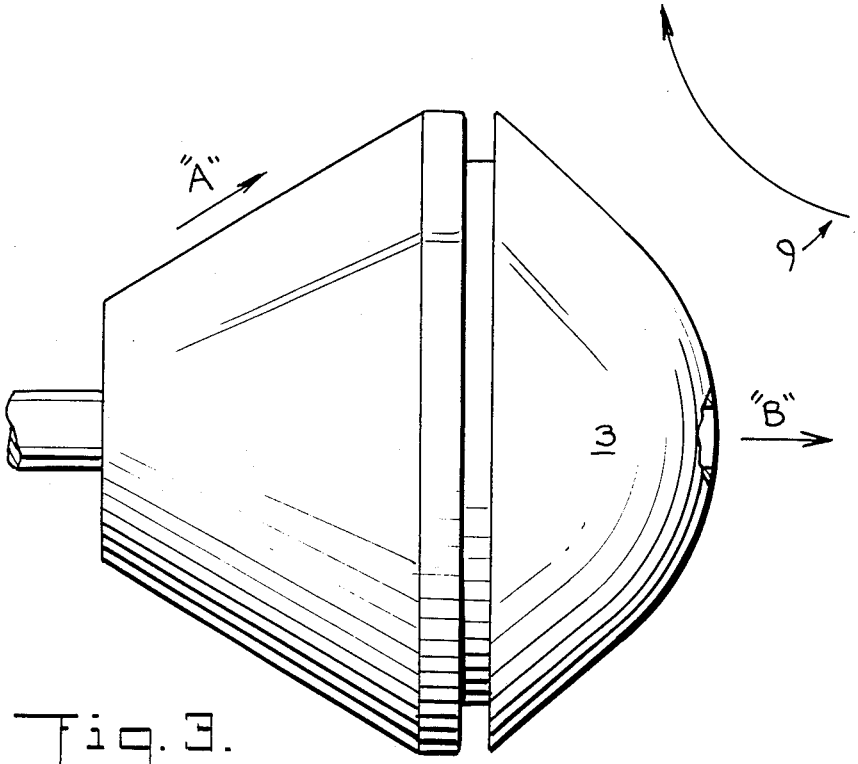
FIG. 3 is a view of the displacing body of the embodiment of FIG. 1 with a free gas jet feed.

In the embodiment of FIG. 3, the displacing body has been shaped in such a way that an auxiliary gas stream A is applied along the outer surface of the displacing body 3 with the support of the free gas jet which is directed in the direction of the article to be coated and which deflects the toroidal vortex flow which is drawn at 9 in FIG. 3. One or more outlet means for providing the free gas jet may be provided. A gas stream B may be ejected from the center of the displacing body 3 directed at the article to be coated.

Figure 1:
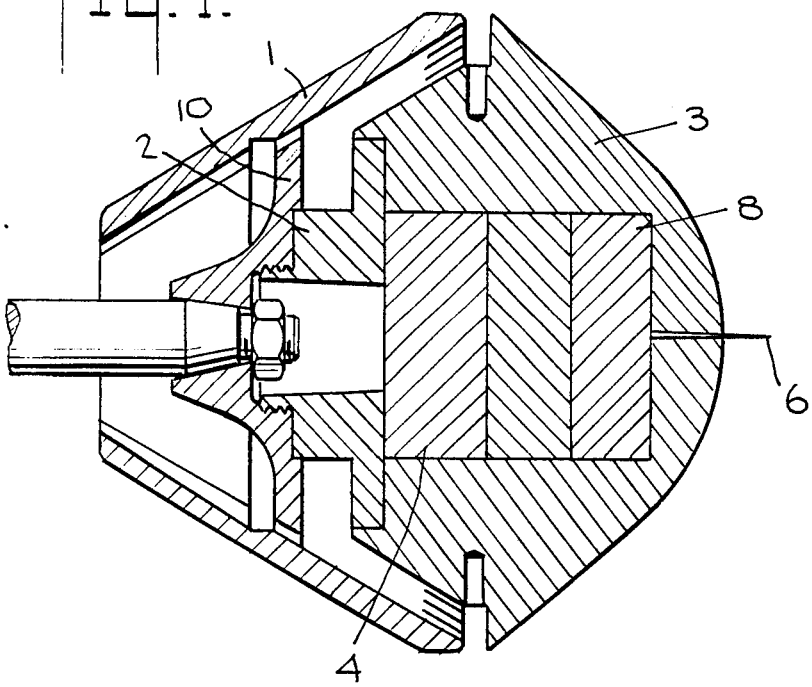
FIG. 1 is a schematic cross-sectional view illustrating one embodiment of the invention having an aerodynamic displacing body which has a parabola-shaped contour.
Figure 2:
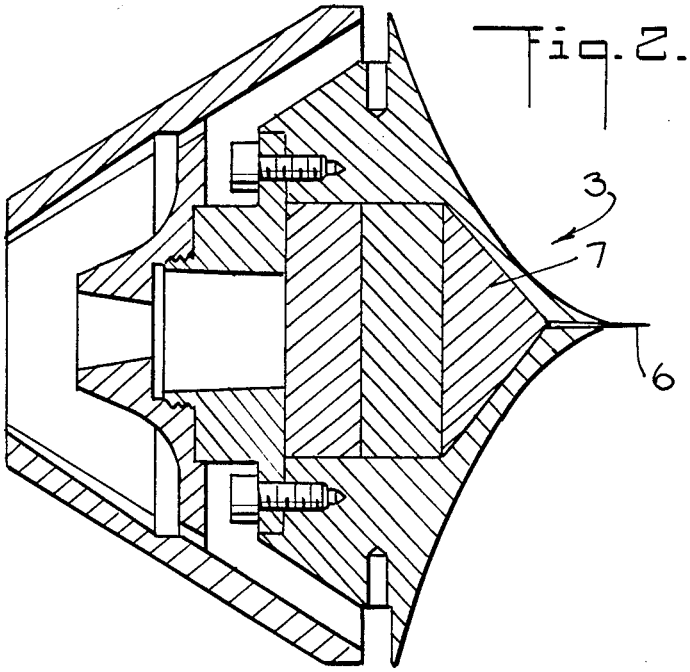
FIG. 2 is a schematic cross-sectional view illustrating another embodiment of the invention having an aerodynamic displacing body which has a contour in the shape of an inverted parabola.

In FIG. 1, the outer surface of the displacing body 3 has the contour of a parabola, while in the embodiment of FIG. 2 the displacing body 3 possesses the outer contour of an inverted parabola. The displacing body 3 may have the outer contour of a hemisphere or a hyperbola. The aerodynamic displacing body 3 suitably provides aerodynamic forces in front of and covering the bell cavity to deflect paint particles flying back in the toroidal vortex toward the bell.

A gas jet may also be generated at the center of the displacing body with this jet directed at the article to be coated.

Figure 4:
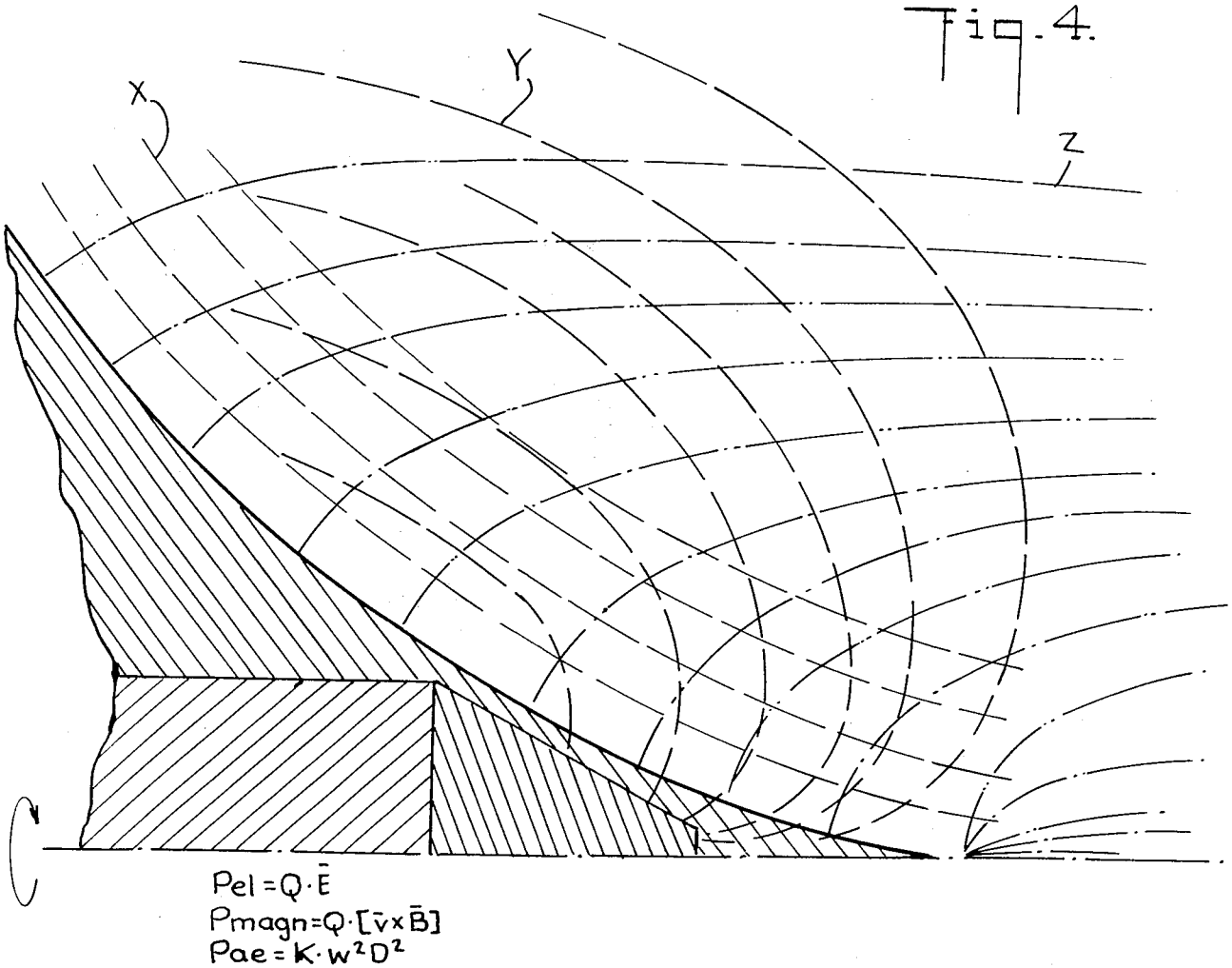
FIG. 4 diagrammatically illustrates how the various forces, according to the invention, which affect the particles flying back combine.

The resulting magnetic field lines, the aerodynamic flow lines and the electric field lines have been illustrated in FIG. 4.

These aerodynamic flow lines carry the reference symbol X, the magnetic field lines carry the reference symbol Y and the electric field lines carry the reference symbol Z.

The aerodynamic force Pae, the magnetic force Pmagn, and the electric repulsion force Pel have hereinbefore been discussed.

The high-speed rotation bell can be, for example, under a direct potential of 90 kv, and the radius of the electrode needle 6 can be 1 mm. The resulting field strength is 90 kv/mm. Since the dielectric strength in air is only 3 kv/mm, the high field strength of 90 kv/mm does not arise, but what does arise is a charge current which is directed at the counterpotential, i.e., for example, an automotive bodyshell to be coated, and thus generates the charge cloud.

Bell type apparatus for electrostatically coating articles with fluids such as paints and which rotate at high speed about a fixed axis are themselves well known in the art. Accordingly, devices for rotating the bell, devices for supplying paint to the bell, and devices for providing a high electrical potential on the bell are not described herein.

It will be understood by one skilled in the art that in such atomizing bells, the paint is fed into the bell cavity, the bell is rotated at high speed and maintained at high electrical potential. The paint is whirled from the atomizing edge of the bell onto the article to be coated.

Although preferred embodiments of the present invention have been discussed in detail, it is contemplated that modifications may be made by those skilled in the art within the spirit and the scope of the present invention.

What is claimed is:

1. In a device for the electrostatic coating of articles with liquids such as quick-evaporating liquid paint, said device including a liquid atomizing bell having a cavity formed from a shell having an atomizing edge facing the article to be coated, said bell being adapted to rotate at high speed about a fixed axis, means for feeding paint into the interior of the bell, and means for generating a high electric potential of a single preselected polarity on the bell, the improvement comprising:

an electrical conducting displacing body located in front of said bell cavity for aerodynamically deflecting said sprayed coating liquids flying back toward said displacing body and said body protruding along said axis outwardly from said bell cavity a substantial distance beyond the atomizing edge of said shell whereby said body points at the articles to be coated; and means for structurally and electrically connecting said body to the bell whereby said body rotates with said bell and electrical conduction occurs between said body and said bell with said body thereby having the same electric potential as said bell.

2. The device recited in claim 1 wherein said body is an electrode needle.

3. The device recited in claim 1 wherein said body is in aerodynamic displacing body substantially covering said bell cavity.

4. A device as recited in claim 3 wherein the displacing body has an outer contour which corresponds to an inverted parabola.

5. A device as recited in claim 3 wherein the displacing body has an outer contour which corresponds to a parabola.

6. A device as recited in claim 3 wherein the displacing body has the outer contour of a hemisphere.

7. A device as claimed in claim 3 wherein the displacing body has the outer contour of a hyperbola.

8. A device as recited in claim 3 wherein the end of said displacing body to face the article to be coated has the form of a tip whose radius is as close as possible to zero.

9. A device as recited in claim 3 wherein there is a zone outside said displacing body and wherein a magnet is disposed within said displacing body whereby a magnetic field is generated in the zone outside said body.

10. A device as recited in claim 8 wherein said tip is made of an electrically conductive material.

11. A device as recited in claim 3 wherein said displacing body has at least one outlet means for providing a free gas jet.

12. A process for electrostatically coating an article with liquids such as quick-evaporating paint, said process including feeding the liquid into a liquid atomizing bell having a cavity formed from a shell having an atomizing edge facing the article to be coated, rotating said bell about a fixed axis at high speed, maintaining said bell under high electrical potential of a single preselected polarity, and whirling the liquid in atomized form from the atomizing edge of the bell onto the article to be coated, the improvement comprising:

providing an electrical conducting displacing body in front of said bell cavity for aerodynamically deflecting said sprayed coating liquid flying back toward said displacing body and said body protruding along said axis outwardly from the bell cavity a substantial distance beyond the atomizing edge of said bell, with said body being structurally and electrically conductively connected to said bell and with said body thereby having the same electric potential as said bell; and generating from said body an electric field in front of said bell cavity and above said body wherein said electric field exceeds the dielectric strength in air at least at one point.

13. A process for electrostatically coating an article with liquids such as quick-evaporating paint, said process including feeding the liquid into a liquid atomizing bell having a cavity formed from a shell having an atomizing edge facing the article to be coated, rotating said bell about a fixed axis at high speed, maintaining said bell under high electrical potential of a single preselected polarity, and whirling the liquid in atomized form from the atomizing edge of the bell onto the article to be coated, the improvement comprising:

providing an electrical conducting displacing body connected to said bell in front of said bell cavity for aerodynamically deflecting said sprayed coating liquid flying back toward said displacing body and said body protruding along said axis outwardly from the bell cavity a substantial distance beyond the atomizing edge of said bell; and generating from said body a magnetic field external to said body in front of said bell cavity.

14. A process for electrostatically coating an article with liquids such as quick-evaporating paint, said process including feeding the liquid into a liquid atomizing bell having a cavity, rotating said bell about a fixed axis at high speed, maintaining said bell under high electrical potential of a single preselected polarity, and whirling the liquid in atomized form from the atomizing edge of the bell onto the article to be coated, the improvement comprising:

providing an electrically conductive aerodynamic displacing body substantially covering said bell cavity in front of and protruding along said axis outwardly from the bell cavity;

creating aerodynamic forces in front of and covering the bell cavity above said aerodynamic displacing body thereby deflecting back paint particles flying back in the toroidal vortex toward said displacing body; and electrically connecting said aerodynamic displacing body to said bell whereby said body has the same electrical potential as said bell and generates an electric field in front of said bell cavity and above said body.

15. A process as recited in claim 12 which further includes generating a magnetic field external to said body in front of said bell cavity.

16. A process as recited in claim 14 further comprising generating a gas jet in the center of the displacing body wherein said gas jet is directed at the article to be coated.

17. A process as recited in claim 15 further comprising generating a gas jet in the center of the displacing body wherein said gas jet is directed at the article to be coated.

18. A process as recited in claim 12 further comprising generating a gas jet in the center of the displacing body wherein said gas jet is directed at the article to be coated.

19. A process as recited in claim 13 further comprising generating a gas jet in the center of the displacing body wherein said gas jet is directed at the article to be coated.

20. A process as recited in claim 14 further comprising generating an auxiliary gas stream along the entire outer contour of the displacing body wherein said auxiliary gas stream is directed at the article to be coated.

21. A process as recited in claim 15 further comprising generating an auxiliary gas stream along the entire outer contour of the displacing body wherein said auxiliary gas stream is directed at the article to be coated.

22. A process as recited in claim 12 further comprising generating an auxiliary gas stream along the entire outer contour of the displacing body wherein said auxiliary gas stream is directed at the article to be coated.

23. A process as recited in claim 13 further comprising generating an auxiliary gas stream along the entire outer contour of the displacing body wherein said auxiliary gas stream is directed at the article to be coated.

24. A process as recited in claim 14 further comprising generating an auxiliary gas stream along the entire outer contour of the displacing body wherein said auxiliary gas stream is directed at the article to be coated.

* * * * *